US011668320B2

(12) United States Patent
Ou et al.

(10) Patent No.: US 11,668,320 B2
(45) Date of Patent: Jun. 6, 2023

(54) FAN FRAME ASSEMBLY

(71) Applicant: VAST GLORY ELECTRONICS & HARDWARE & PLASTIC(HUI ZHOU) LTD., Hui Zhou (CN)

(72) Inventors: Xiangwei Ou, Hui Zhou (CN); Dian Sheng Liu, Hui Zhou (CN); Shi Man Xu, Hui Zhou (CN)

(73) Assignee: VAST GLORY ELECTRONICS & HARDWARE & PLASTIC(HUI ZHOU) LTD., Hui Zhou (CN)

( * ) Notice: Subject to any disclaimer, the term of this patent is extended or adjusted under 35 U.S.C. 154(b) by 0 days.

(21) Appl. No.: 17/575,241

(22) Filed: Jan. 13, 2022

(65) Prior Publication Data

US 2023/0102485 A1 Mar. 30, 2023

(30) Foreign Application Priority Data

Sep. 24, 2021 (CN) ..... 202111120423.3

(51) Int. Cl.
*F04D 29/52* (2006.01)
*F04D 19/00* (2006.01)

(52) U.S. Cl.
CPC ..... *F04D 29/522* (2013.01); *F04D 19/002* (2013.01)

(58) Field of Classification Search
CPC ..... F04D 29/522; F04D 19/002
See application file for complete search history.

(56) References Cited

U.S. PATENT DOCUMENTS 8,123,461 B2 * 2/2012 Yoshida ..... F04D 19/007 415/214.1
9,897,094 B2 * 2/2018 Kang ..... F04D 29/522
2002/0122733 A1 * 9/2002 Lin ..... F04D 29/522 417/423.5
2009/0022587 A1 * 1/2009 Yoshida ..... F04D 25/166 415/213.1
2009/0214337 A1 * 8/2009 Yoshida ..... F04D 25/0613 415/214.1
2009/0246015 A1 * 10/2009 Hsu ..... F04D 19/007 415/213.1
2013/0004293 A1 * 1/2013 Zhao ..... F04D 25/0613 415/66
2015/0167678 A1 * 6/2015 Yamazaki ..... F04D 29/403 415/183
2018/0195525 A1 * 7/2018 Hakozaki ..... F04D 29/384
2019/0301472 A1 * 10/2019 Kato ..... F04D 19/024
(Continued)

*Primary Examiner* — Aaron R Eastman
(74) *Attorney, Agent, or Firm* — Maschoff Brennan

(57) ABSTRACT

A fan frame assembly includes a first fan frame and a second fan frame. The first fan frame includes a first annular wall part and a plurality of first engagement parts connected to the first annular wall part. The second fan frame includes a second annular wall part and a plurality of second engagement parts connected to the second annular wall part. Each of the first engagement parts has a positioning structure extending along an axial direction of the first annular wall part, and each of the second engagement parts has a positioning structure extending along the axial direction of the first annular wall part. when the first engagement parts and the second engagement parts are respectively engaged with each other, the positioning structures of the second engagement parts are positioned by the positioning structures of the first engagement parts.

9 Claims, 8 Drawing Sheets

(56) References Cited

U.S. PATENT DOCUMENTS

| | | | | |
|---|---|---|---|---|
| 2019/0301473 | A1* | 10/2019 | Kato | H02K 16/00 |
| 2020/0217322 | A1* | 7/2020 | Chang | F04D 25/0613 |
| 2021/0277916 | A1* | 9/2021 | Ma | F04D 29/646 |

* cited by examiner

FAN FRAME ASSEMBLY

CROSS-REFERENCE TO RELATED APPLICATIONS

This non-provisional application claims priority under 35 U.S.C. § 119(a) on Patent Application No(s). 202111120423.3 filed in China on Sep. 24, 2021, the entire contents of which are hereby incorporated by reference.

TECHNICAL FIELD

The disclosure provides a fan frame assembly, more particularly to a fan frame assembly of combined type.

BACKGROUND

With the advancement of technology, many electronic components are designed to have small sizes and have high-speed performance. Especially, microprocessors (CPUs) in computer products attract more attentions to consumers with powerful and high-speed performance. In general, the higher the speed of the CPU, the more heat generated. If the heat is unable to be taken away from the CPU effectively, it may adversely affect the CPU. Therefore, due to this, it is a very common design to install a small fan on the CPU.

However, one small fan is unable to provide sufficient airflows to the CPU for taking away heat generated from the CPU. Furthermore, this small fan may be in malfunction sometimes. Therefore, an additional fan is in series connection with this small fan for solving the aforementioned issue. The two fans are fixed to each other via screws or rivets, but it is troublesome and inconvenient to assemble the two fans with each other or dissembled the two fans from each other, and the screws and rivets may adversely affect the appearance of the assembly of the two fans. As a result, how to easily and efficiently assemble the two fans with each other or dissembled the two fans from each other is one of the crucial topics in this field.

SUMMARY

The disclosure provides a fan frame assembly which have two fan frames of fans in series connection that can be assembled in an efficient manner.

One embodiment of the disclosure provides a fan frame assembly. The fan frame assembly includes a first fan frame and a second fan frame. The first fan frame includes a first annular wall part and a plurality of first engagement parts. The first annular wall part has a first outer surface, and the first engagement parts protrude from the first outer surface of the first annular wall part. The second fan frame includes a second annular wall part and a plurality of second engagement parts. The second annular wall part has a second outer surface, and the second engagement parts protrude from the second outer surface of the second annular wall part. Each of the first engagement parts has a first positioning surface, a second positioning surface, and a first positioning structure. In each of the first engagement parts, the first positioning surface and the second positioning surface are arranged along an axial direction of the first fan frame and face away from each other, and the first positioning structure is located at the first positioning surface. Each of the second engagement parts has a third positioning surface, a fourth positioning surface, a groove, and a second positioning structure. In each of the second engagement parts, the third positioning surface and the fourth positioning surface are arranged along an axial direction of the second fan frame and face each other, the groove is formed between the third positioning surface and the fourth positioning surface, the second positioning structure is located at the third positioning surface, the second positioning structure is one of a recess and a protrusion mating each other, and the first positioning structure is another one of the recess and the protrusion mating each other. The first engagement parts are respectively and slidably located in the grooves of the second engagement parts, the third positioning surfaces of the second engagement parts respectively face the first positioning surfaces of the first engagement parts, and the second positioning structures of the second engagement parts are respectively positioned by the first positioning structures of the first engagement parts.

Another embodiment of the disclosure provides a fan frame assembly. The fan frame assembly includes a first fan frame and a second fan frame. The first fan frame includes a first annular wall part and a plurality of first engagement parts connected to the first annular wall part. The second fan frame includes a second annular wall part and a plurality of second engagement parts connected to the second annular wall part. Each of the first engagement parts has a positioning structure extending along an axial direction of the first annular wall part, and each of the second engagement parts has a positioning structure extending along the axial direction of the first annular wall part. when the first engagement parts and the second engagement parts are respectively engaged with each other, the positioning structures of the second engagement parts are positioned by the positioning structures of the first engagement parts.

According to the fan frame assemblies as discussed in the above embodiments, the first engagement parts and the second engagement parts each have a positioning structure extending along the axial direction of the first annular wall part, and when the first engagement parts and the second engagement parts are engaged with each other, the positioning structures of the second engagement parts are positioned by the positioning structures of the first engagement parts. Therefore, the first fan frame and the second fan frame of fans in series connection can be assembled with each other in an efficient manner.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
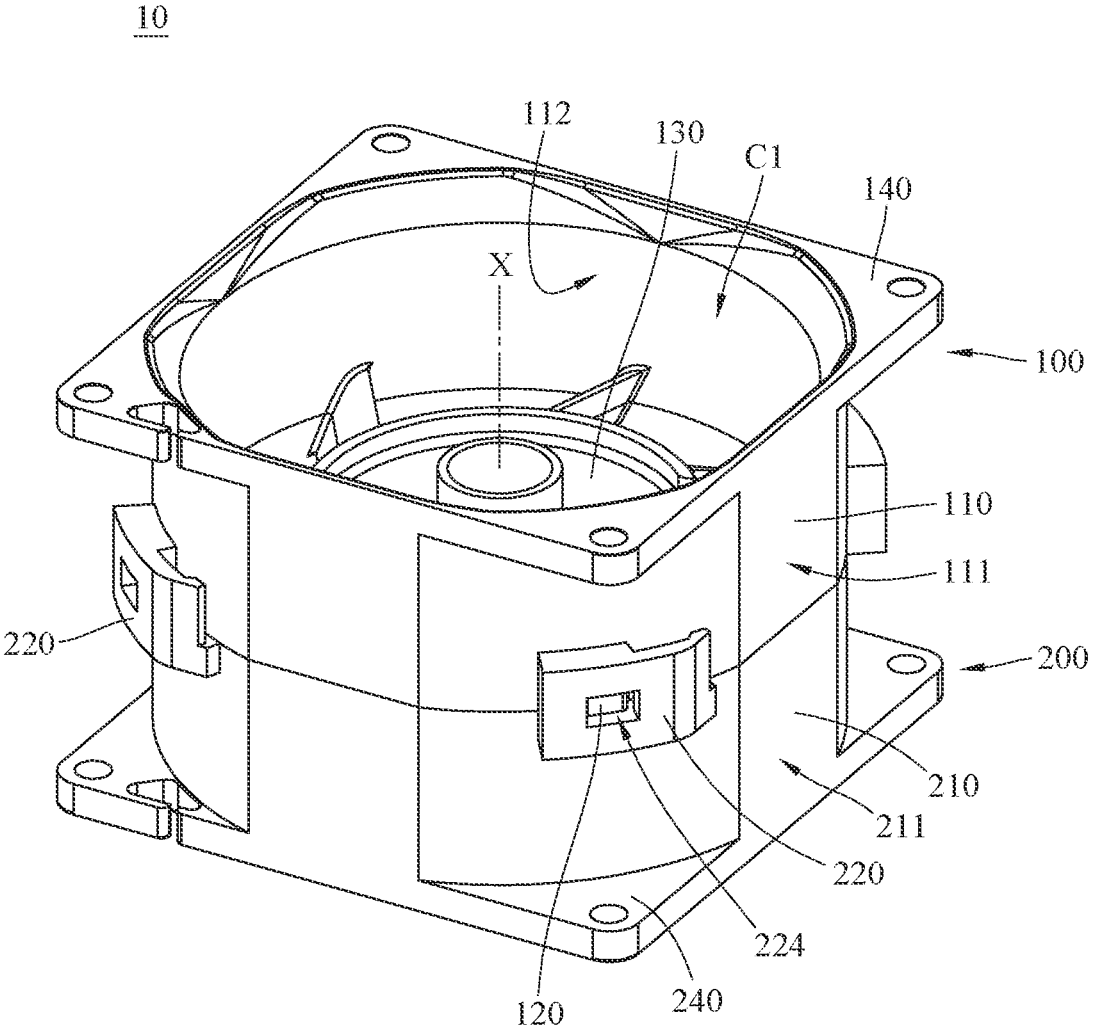
FIG. 1 is a perspective view of a fan frame assembly according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
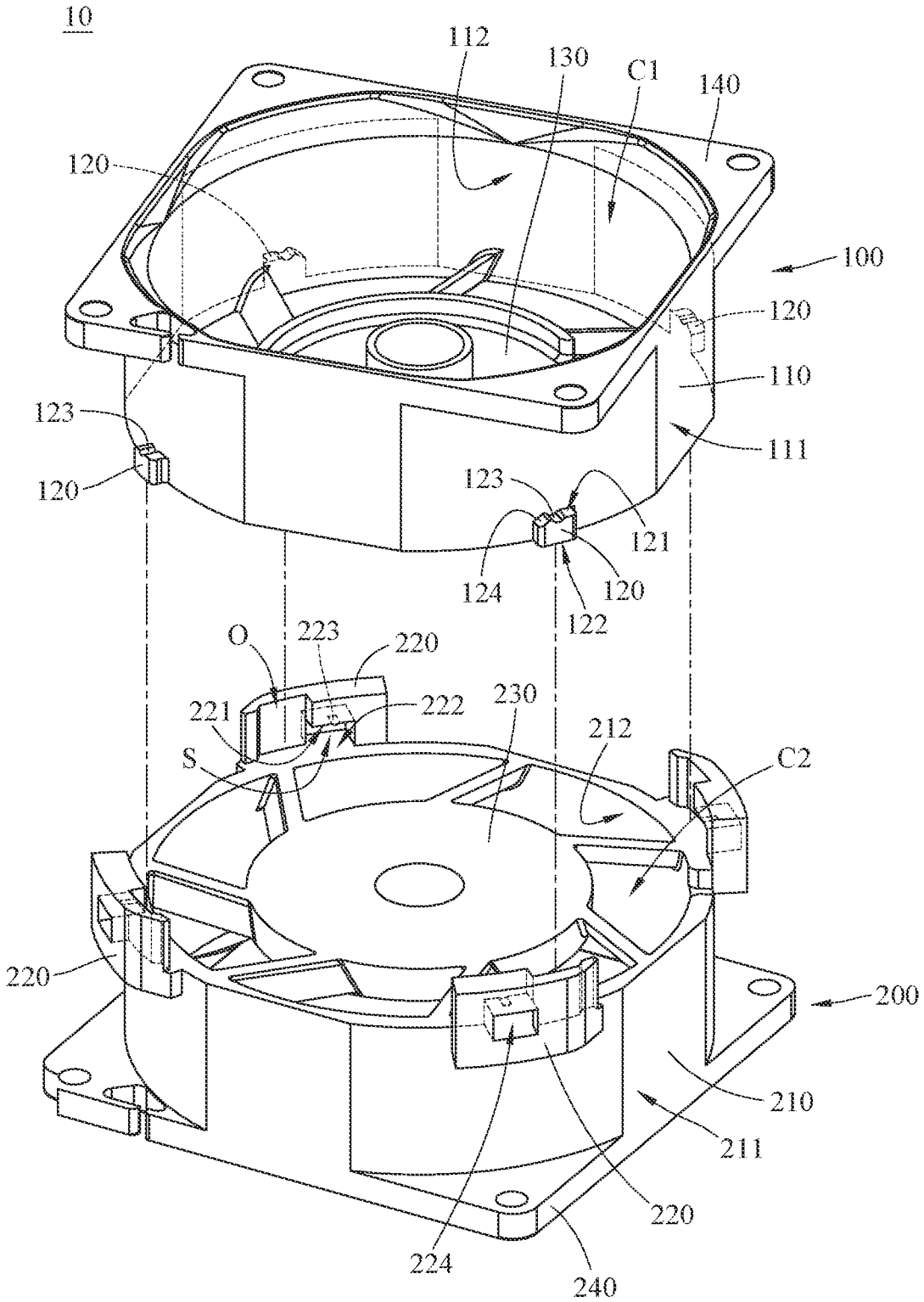
FIG. 2 is an exploded view of the fan frame assembly in FIG. 1.

Referring to FIGS. 1 to 2, FIG. 1 is a perspective view of a fan frame assembly 10 according to one embodiment of the disclosure, and FIG. 2 is an exploded view of the fan frame assembly 10 in FIG. 1.

In this embodiment, the fan frame assembly 10 is formed by fan frames of two axial fans in series connection; that is, the fan frames are arranged side by side. In detail the fan frame assembly 10 includes a first fan frame 100 and a second fan frame 200. The first fan frame 100 and the second fan frame 200 each are configured to be assembled with an axial-flow impeller (not shown). The axial-flow impellers can rotate relative to the first fan frame 100 or the second fan frame 200 about an axis X. The second fan frame 200 is removably mounted on the first fan frame 100, and the first fan frame 100 and the second fan frame 200 are arranged axially; that is, the axial-flow impellers are in series connection via the first fan frame 100 and the second fan frame 200.

In this embodiment, the first fan frame 100 includes a first annular wall part 110, a plurality of first engagement parts 120, and a first shaft support part 130. The first annular wall part 110 has a first outer surface 111 and a first inner surface 112 face away from each other. The first inner surface 112 surrounds and forms a first accommodation space C1. The first engagement parts 120 protrude from the first outer surface 111 of the first annular wall part 110. The first shaft support part 130 is connected to the first inner surface 112 of the first annular wall part 110 and located at a side of the first annular wall part 110. The first shaft support part 130 is configured to be assembled with a shaft of one axial-flow impeller, such that this axial-flow impeller is located in the first accommodation space C1.

In this embodiment, the second fan frame 200 includes a second annular wall part 210, a plurality of second engagement parts 220, and a second shaft support part 230. The second annular wall part 210 has a second outer surface 211 and a second inner surface 212 face away from each other. The second inner surface 212 surrounds and forms a second accommodation space C2. The second engagement parts 220 protrude from the second outer surface 211 of the second annular wall part 210. The second shaft support part 230 is connected to the second inner surface 212 of the second annular wall part 210 and located at a side of the second annular wall part 210. The second shaft support part 230 is configured to be assembled with a shaft of another axial-flow impeller, such that this axial-flow impeller is located in the second accommodation space C2. When the first fan frame 100 and the second fan frame 200 are assembled with each other, the first shaft support part 130 is in contact with the second shaft support part 230.

Figure 3:
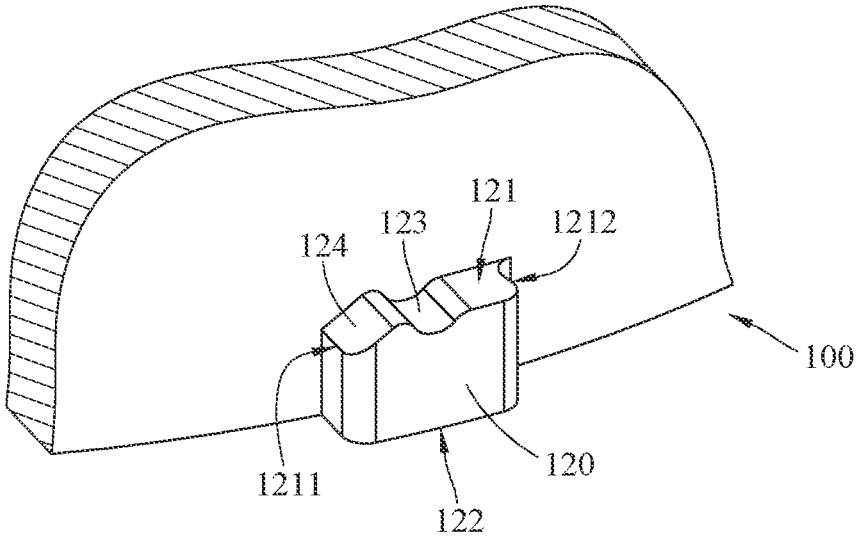
FIG. 3 is a partial perspective view of a first fan frame of the fan frame assembly in FIG. 1.
Figure 4:
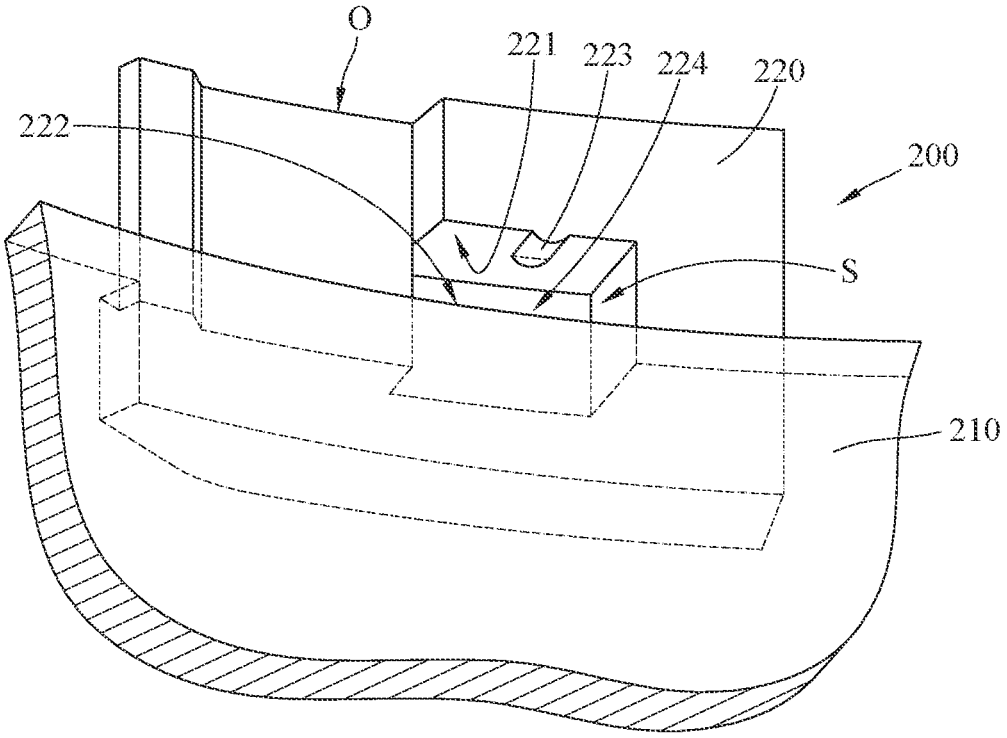
FIG. 4 is a partial perspective view of a second fan frame of the fan frame assembly in FIG. 1.

Referring to FIGS. 2 to 4, FIG. 3 is a partial perspective view of the first fan frame 100 of the fan frame assembly 10 in FIG. 1, and FIG. 4 is a partial perspective view of the second fan frame 200 of the fan frame assembly 10 in FIG. 1.

As shown in FIGS. 2 and 3, the first engagement parts 120 are the same with one another in structure, and thus the following paragraphs merely introduce one of them. The first engagement part 120 has a first positioning surface 121, a second positioning surface 122, and a first positioning structure 123. The first positioning surface 121 and the second positioning surface 122 are arranged along an axial direction of the first fan frame 100 and face away from each other, normal lines of the first positioning surface 121 and the second positioning surface 122 are parallel to the axial direction of the first fan frame 100, and the first positioning structure 123 is located at the first positioning surface 121, where the axial direction of the first fan frame 100 is parallel to the axis X.

In this embodiment, the first positioning surface 121 has a first side 1211 and a second side 1212 located opposite to each other in a circumferential direction of the first annular wall part 110. The first positioning structure 123 is spaced apart from the first side 1211 and the second side 1212. That is, in the circumferential direction of the first annular wall part 110, the first positioning structure 123 is located at a middle portion of the first positioning surface 121.

In this embodiment, the first positioning surface 121 has an inclined portion 124 located at the first side 1211, such that a thickness of the first engagement part 120 at the first side 1211 is smaller than a thickness of the first engagement part 120 at the second side 1212. The inclined portion 124 assists the first engagement part 120 to be smoothly engaged with the second engagement part 220.

As shown in FIGS. 2 and 4, the second engagement parts 220 are the same with one another in structure, and thus the following paragraphs merely introduce one of them. The second engagement part 220 has a third positioning surface 221, a fourth positioning surface 222, a groove S, and a second positioning structure 223. The third positioning surface 221 and the fourth positioning surface 222 are arranged along an axial direction of the second fan frame 200 and face each other. The groove S is formed between the third positioning surface 221 and the fourth positioning surface 222. The groove S extends along a circumferential direction of the fan frame assembly 10. The second positioning structure 223 is located at the third positioning surface 221, and the second positioning structure 223 and the first positioning structure 123 are respectively a protrusion and a recess mating each other. The first engagement part 120 is slidably located in the groove S, the third positioning surface 221 faces the first positioning surface 121, and the second positioning structure 223 is positioned by the first positioning structure 123.

In this embodiment, the second engagement part 220 has a mount hole O. The mount hole O extends along an axial direction of the fan frame assembly 10 and connected to the groove S. The mount hole O can guide the first engagement part 120 into the groove S.

In this embodiment, the first positioning structure 123 is a recess having a curved bottom surface, and the second positioning structure 223 is a protrusion having a curved surface, such that the first positioning structure 123 and the second positioning structure 223 can be engaged with each other smoothly. Note that the shapes of the first positioning structure 123 and the second positioning structure 223 are not restricted thereto and may be modified as required.

In this embodiment, the second engagement part 220 has an opening 224 connected to the groove S. When the second positioning structure 223 is located at the first positioning structure 123, the first engagement part 120 is exposed from the opening 224.

In this embodiment, the first fan frame 100 further includes at least one first flange part 140 connected to another side of the first annular wall part 110. That is, the first flange part 140 and the first shaft support part 130 are respectively connected to two opposite sides of the first annular wall part 110. The first flange part 140 is configured for a screw to be disposed through so as to be fixed on an object, such as a heat sink or a CPU.

The second fan frame 200 further includes at least one second flange part 240 connected to another side of the second annular wall part 210. When the first fan frame 100 and the second fan frame 200 are assembled with each other, the first flange part 140 and the second flange part 240 are respectively located at two opposite sides of the fan frame assembly 10.

Figure 6:
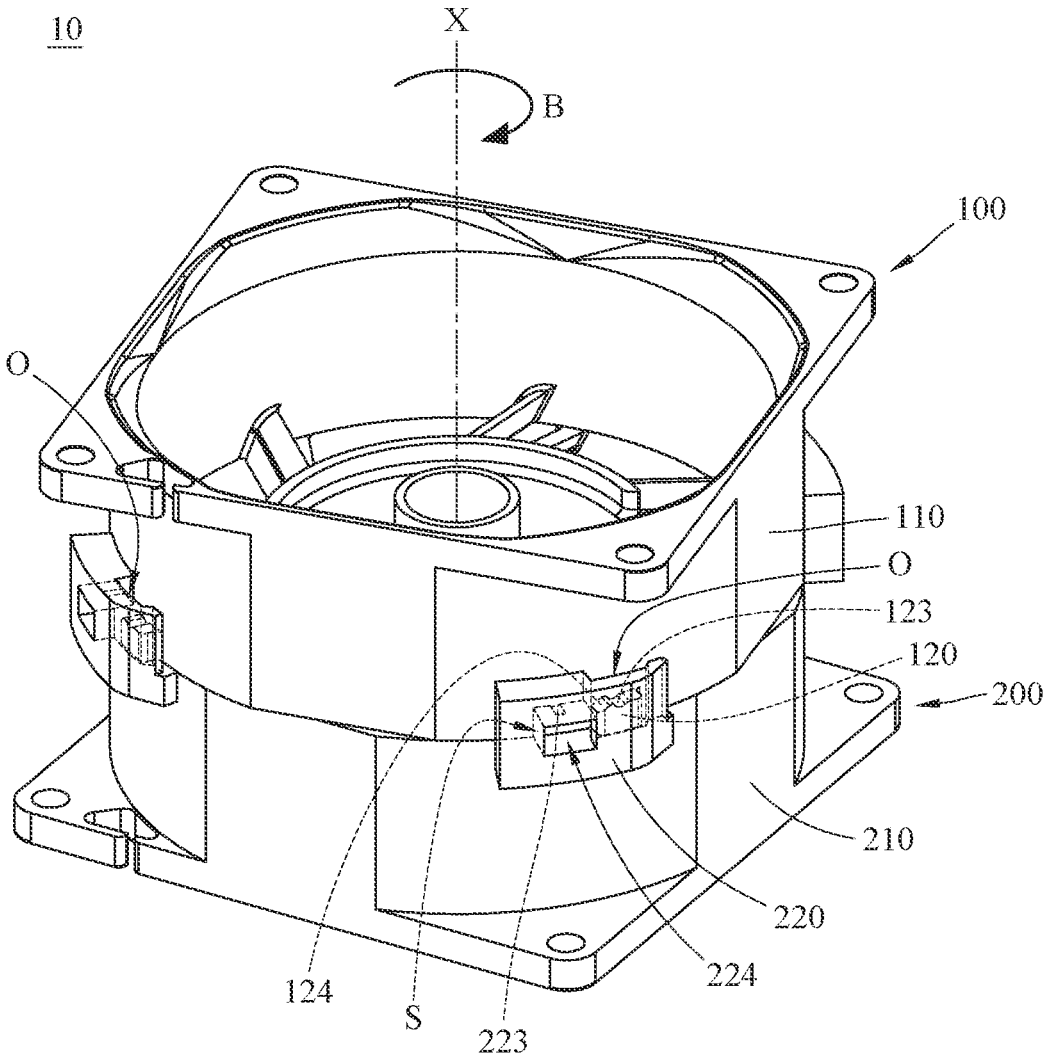
Figure 7:
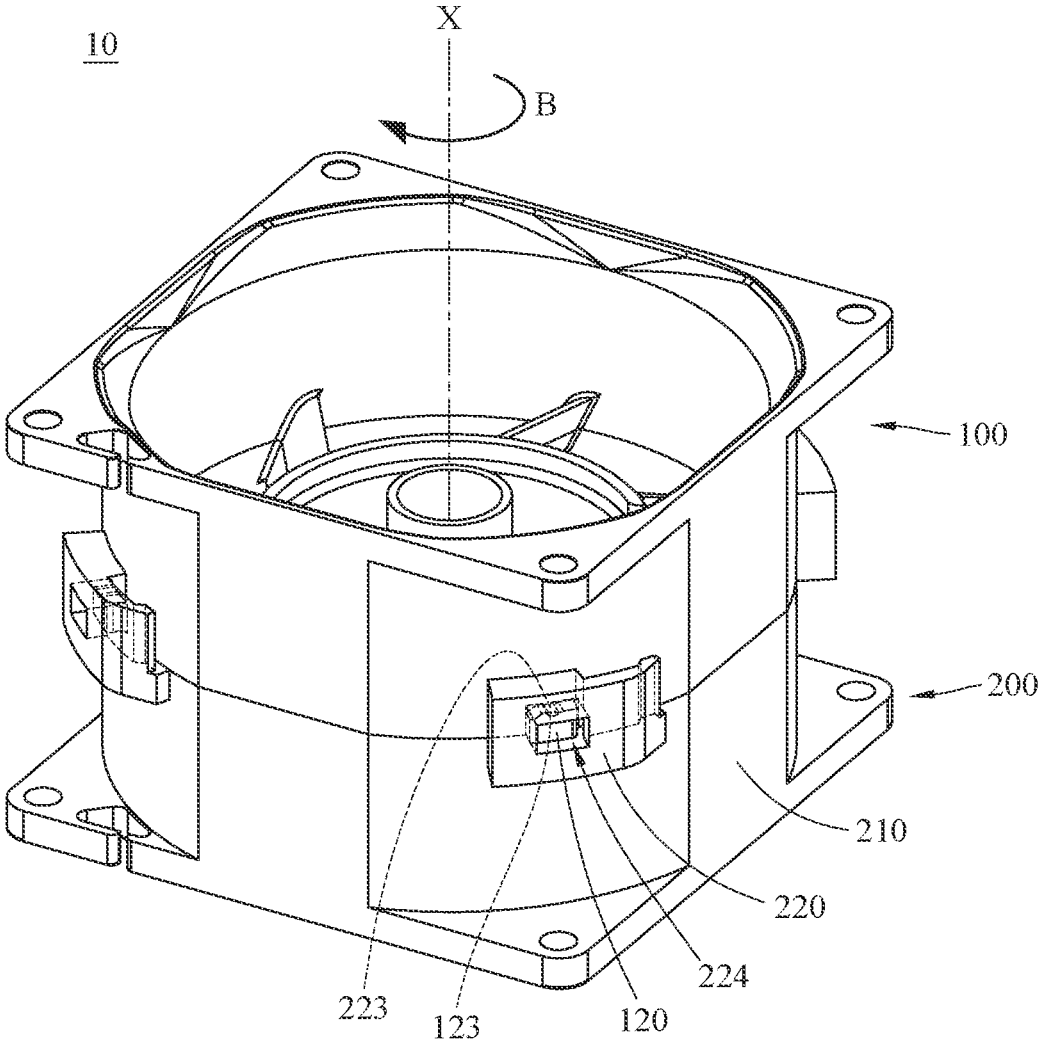
Figure 8:
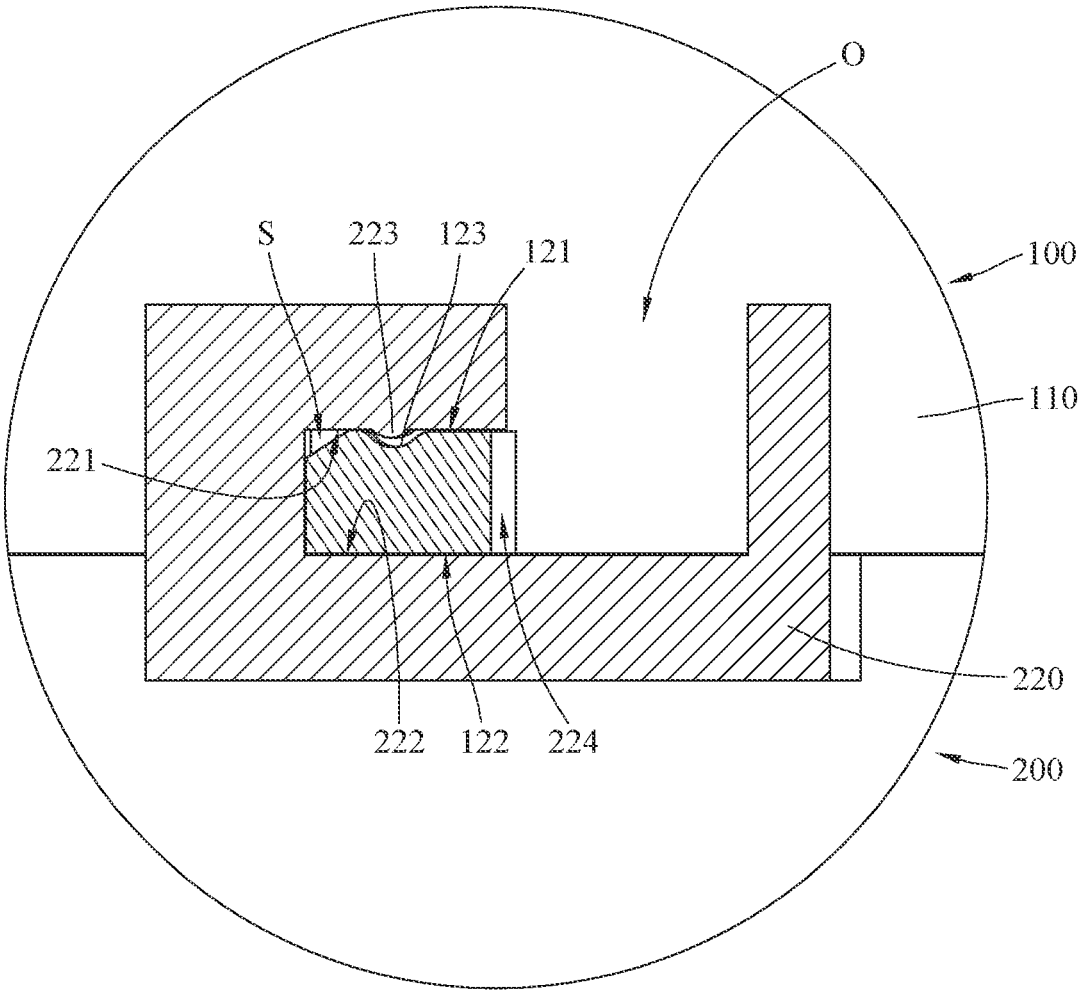
FIG. 8 is a partial cross-sectional view of the fan frame assembly in FIG. 1.
Figure 9:
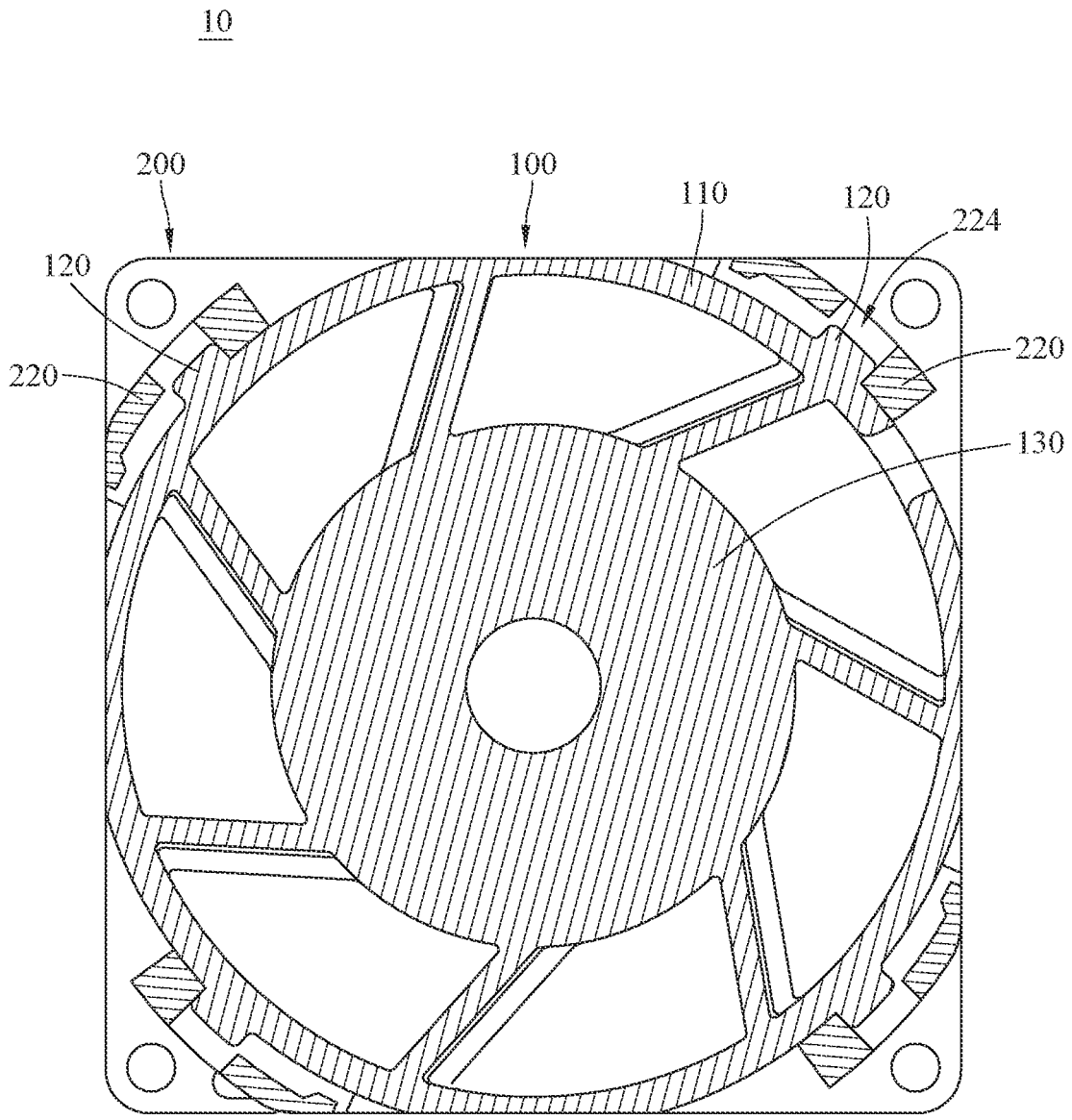
FIG. 9 is another cross-sectional view of the fan frame assembly in FIG. 1.

Referring to FIGS. 5 to 9, FIGS. 5 to 7 show an assembly process of the first fan frame 100 and the second fan frame 200 in FIG. 1, FIG. 8 is a partial cross-sectional view of the fan frame assembly 10 in FIG. 1, and FIG. 9 is another cross-sectional view of the fan frame assembly 10 in FIG. 1. The following paragraphs will introduce the assembly process of the first fan frame 100 and the second fan frame 200.

Figure 5:
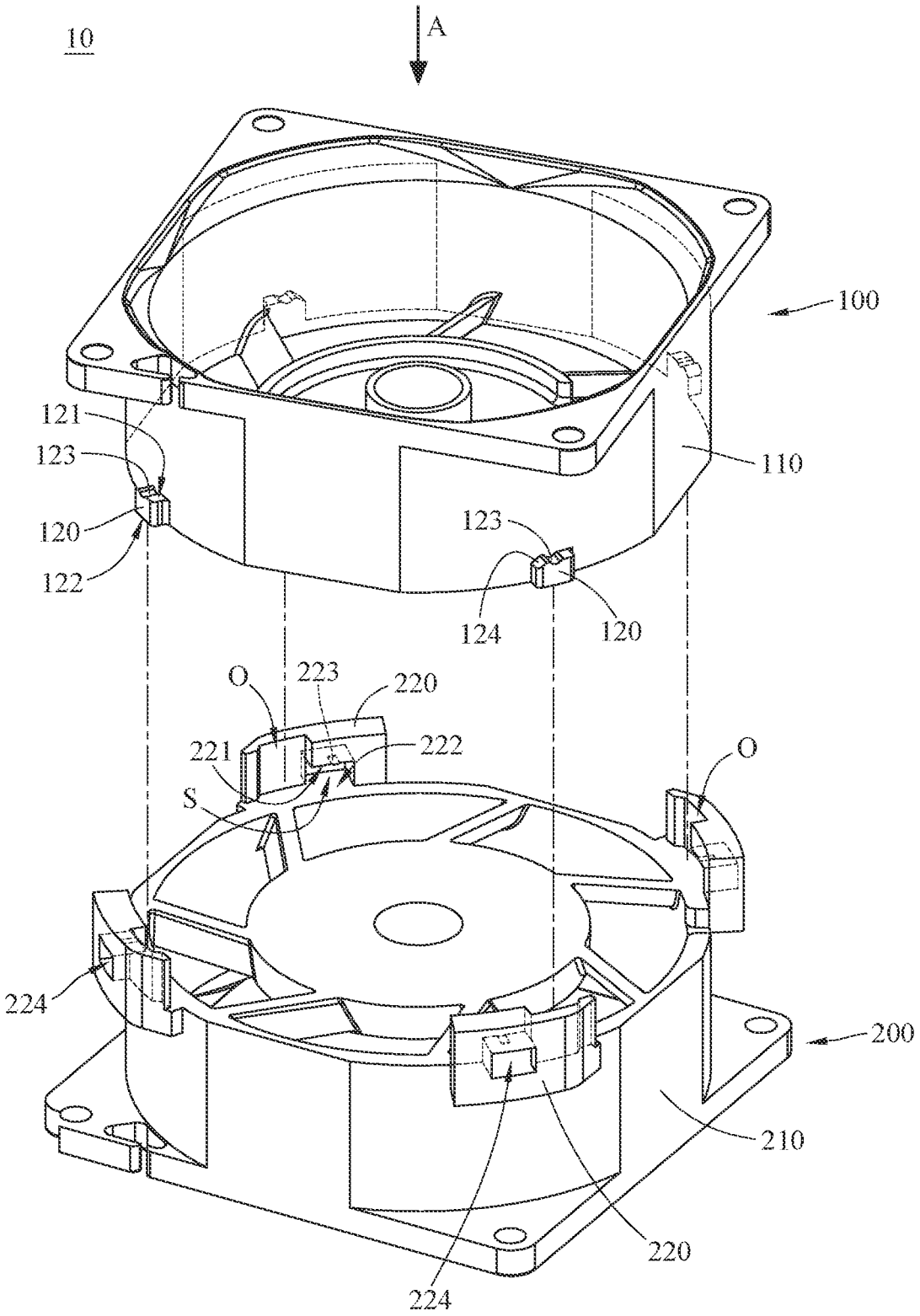
FIGS. 5 to 7 show an assembly process of the first fan frame and the second fan frame in FIG. 1.

As shown in FIGS. 5 and 6, the first fan frame 100 and the second fan frame 200 are moved to be close to each other (e.g., along a direction A), then the first engagement part 120 of the first fan frame 100 enters into the groove S of the second engagement parts 220 from the mount hole O.

Then, as shown in FIGS. 6 and 7, the second fan frame 200 is rotated (e.g., along a direction B) so as to move the first engagement part 120 deeper into the groove S, such that the second positioning structure 223 of the second engagement part 220 is limited in position and positioned by the first positioning structure 123 of the first engagement part 120. In addition, as shown in FIG. 8, when the first fan frame 100 and the second fan frame 200 are assembled with each other, the first positioning surface 121 is in contact with the third positioning surface 221, and the second positioning surface 122 is in contact with the fourth positioning surface 222 so as to limit the movements of the first fan frame 100 and the second fan frame 200 in the axial direction of the fan frame assembly 10. Further, as shown in FIG. 9, the second engagement part 220 is in contact with the first annular wall part 110 so as to limit the movements of the of the first fan frame 100 and the second fan frame 200 in the radial direction of the fan frame assembly 10. As a result, the first fan frame 100 and the second fan frame 200 of fans in series connection can be assembled with each other in an efficient manner.

Note that the arrangement and configuration of the fan frame assembly 10 is exemplary; in some other embodiments, the fan frame assembly may also include a first fan frame and a second fan frame. The first fan frame may include a first annular wall part and a plurality of first engagement parts connected to the first annular wall part. The second fan frame may include a second annular wall part and a plurality of second engagement parts connected to the second annular wall part, where each of the first engagement parts may have a positioning structure extending along an axial direction of the first annular wall part, each of the second engagement parts may have a positioning structure extending along the axial direction of the first annular wall part. When the first engagement parts and the second engagement parts are respectively engaged with each other, the positioning structures of the second engagement parts are positioned by the positioning structures of the first engagement parts.

According to the fan frame assemblies as discussed in the above embodiments, the first engagement parts and the second engagement parts each have a positioning structure extending along the axial direction of the first annular wall part, and when the first engagement parts and the second engagement parts are engaged with each other, the positioning structures of the second engagement parts are positioned by the positioning structures of the first engagement parts. Therefore, the first fan frame and the second fan frame of fans in series connection can be assembled with each other in an efficient manner.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A fan frame assembly, comprising:

a first fan frame, comprising a first annular wall part and a plurality of first engagement parts, wherein the first annular wall part has a first outer surface, and the plurality of first engagement parts protrude from the first outer surface of the first annular wall part; and a second fan frame, comprising a second annular wall part and a plurality of second engagement parts, wherein the second annular wall part has a second outer surface, and the plurality of second engagement parts protrude from the second outer surface of the second annular wall part;

wherein each of the plurality of first engagement parts has a first positioning surface, a second positioning surface, and a first positioning structure; in each of the plurality of first engagement parts, the first positioning surface and the second positioning surface are arranged along an axial direction of the first fan frame and face away from each other, and the first positioning structure is located at the first positioning surface;

wherein each of the plurality of second engagement parts has a third positioning surface, a fourth positioning surface, a groove, and a second positioning structure; in each of the plurality of second engagement parts, the third positioning surface and the fourth positioning surface are arranged along an axial direction of the second fan frame and face each other, the groove is formed between the third positioning surface and the fourth positioning surface, the second positioning structure is located at the third positioning surface, the second positioning structure is one of a recess and a protrusion mating each other, and the first positioning structure is another one of the recess and the protrusion mating each other;

wherein the plurality of first engagement parts are respectively and slidably located in the grooves of the plurality of second engagement parts, the third positioning surfaces of the plurality of second engagement parts respectively face the first positioning surfaces of the plurality of first engagement parts, and the second positioning structures of the plurality of second engagement parts are respectively positioned by the first positioning structures of the plurality of first engagement parts;

wherein each of the second engagement parts has an inner surface and a mount hole, the mount hole and the groove are recessed from the inner surface, the mount hole extends along the axial direction of the second fan frame, and the groove extends along a circumferential direction of the second fan frame and is connected to the mount hole.

2. The fan frame assembly according to claim 1, wherein the first positioning structures of the plurality of first engagement parts are recesses, and the second positioning structures of the plurality of second engagement parts are protrusions.

3. The fan frame assembly according to claim 1, wherein the first positioning structures of the plurality of first engagement parts are recesses which each have a curved bottom surface, and the second positioning structures of the plurality of second engagement parts are protrusions which each have a curved surface.

4. The fan frame assembly according to claim 1, wherein each of the plurality of second engagement parts has an opening connected to the groove; when the second positioning structures of the plurality of second engagement parts are respectively located at the first positioning structures of the plurality of first engagement parts, the plurality of first engagement parts are respectively exposed from the openings of the plurality of second engagement parts.

5. The fan frame assembly according to claim 1, wherein in each of the plurality of first engagement parts, the first positioning structure is located at a middle portion of the first positioning surface.

6. The fan frame assembly according to claim 1, wherein in each of the plurality of first engagement parts, the first positioning surface has a first side and a second side located opposite to each other in a circumferential direction of the first annular wall part, and the first positioning structure is spaced apart from the first side and the second side of the first positioning surface.

7. The fan frame assembly according to claim 6, wherein in each of the plurality of first engagement parts, the first positioning surface has an inclined portion located at the first side of the first positioning surface, a thickness of each of the plurality of first engagement parts at the first side is smaller than a thickness of each of the plurality of first engagement parts at the second side.

8. The fan frame assembly according to claim 1, wherein the first fan frame further comprises a first shaft support part connected to a side of the first annular wall part, and the second fan frame further comprises a second shaft support part connected to a side of the second annular wall part; when the first fan frame and the second fan frame are assembled with each other, the first shaft support part is in contact with the second shaft support part.

9. The fan frame assembly according to claim 8, wherein the first fan frame further comprises a first flange part connected to another side of the first annular wall part, and the second fan frame further comprises a second flange part connected to another side of the second annular wall part; when the first fan frame and the second fan frame are assembled with each other, and the first flange part and the second flange part are respectively located at two opposite sides of the fan frame assembly.

* * * * *